US006870098B2

(12) United States Patent
Robbins

(10) Patent No.: US 6,870,098 B2
(45) Date of Patent: Mar. 22, 2005

(54) CONDUIT-READY TERMINAL COVER

(75) Inventor: Elizabeth A. Robbins, Adrian, MI (US)

(73) Assignee: Tecumseh Products Company, Tecumseh, MI (US)

( * ) Notice: Subject to any disclaimer, the term of this patent is extended or adjusted under 35 U.S.C. 154(b) by 142 days.

(21) Appl. No.: 10/252,268

(22) Filed: Sep. 23, 2002

(65) Prior Publication Data

US 2004/0055773 A1 Mar. 25, 2004

(51) Int. Cl.[7] ..... H01J 5/00

(52) U.S. Cl. ..... 174/50.5; 174/50; 174/50.51; 361/600; 415/182.1

(58) Field of Search ..... 174/50, 50.5, 50.51, 174/52.1, 52.2, 52.3, 66, 67, 17 R, 65 R; 220/3.2, 3.3, 4.02, 3.4, 3.7, 3.5, 3.6, 3.8; 361/600, 601; 417/410.3, 410.4, 410.5, 902; 415/182.1

(56) References Cited

U.S. PATENT DOCUMENTS 4,620,061 A * 10/1986 Appleton ..... 174/51
4,840,547 A * 6/1989 Fry ..... 174/138 F
4,964,788 A * 10/1990 Itameri-Kinter et al. .... 174/152 GM
5,222,885 A * 6/1993 Cooksey ..... 418/96
5,266,016 A * 11/1993 Kandpal ..... 417/569
5,306,126 A * 4/1994 Richardson, Jr. ..... 418/1
5,422,437 A * 6/1995 Schnell ..... 174/65 R
5,636,758 A * 6/1997 Su ..... 220/3.8
6,203,290 B1 * 3/2001 Tamura et al. ..... 417/410.3
6,278,061 B1 * 8/2001 Daoud ..... 174/65 R
6,361,293 B1 * 3/2002 Harper et al. ..... 417/363
6,460,567 B1 * 10/2002 Hansen et al. ..... 137/554

* cited by examiner

*Primary Examiner*—Dean A. Reichard
*Assistant Examiner*—Angel R. Estrada
(74) *Attorney, Agent, or Firm*—Baker & Daniels

(57) ABSTRACT

A hermetically sealed compressor assembly including a housing, an electric motor disposed in the housing, a compression mechanism disposed in the housing and operatively coupled to the motor, a cover attached to the housing and including an integral fitting having at least one clip therein. The clip is structured and arranged such that a conduit to be electrically connected to the compressor assembly enters the cover wherein the clip engages the conduit and prevents the egress of the conduit.

20 Claims, 5 Drawing Sheets

CONDUIT-READY TERMINAL COVER

BACKGROUND OF THE INVENTION

1. Field of the Invention

The present invention relates to compressor assemblies, specifically providing electrical connections to hermetic compressor assemblies.

2. Description of the Related Art

It is well-known to provide an electrical connection to a compressor for operation of that compressor or compressor assembly. Previous terminal covers for compressors utilized a through-hole drilled into the cover for connection of a fitting which would then be used to receive the conduit containing the electrical wires for the power supply. Such terminal covers, while commonly used, required the use of another fitting, in addition to the cover and conduit, thereby requiring multiple parts to connect the conduit and the compressor. The requirement of multiple parts further created a need for additional time to complete the connection since a through-hole must be drilled in the cover, the fitting connected to the cover, the cover connected to the compressor, and finally the conduit connected to the compressor through the fitting and the cover. Thus, previous terminal covers proved to be problematic in usage and implementation.

Covers are not unique to compressors; rather, covers are necessary for many different electrical devices, specifically those electrical devices which include electrical connections to an external power source. Such covers may include a mechanism for holding a cable or a conduit inserted into the cover securely such that the electrical connection is not broken during ordinary use of the electrical device. Some previous mechanisms include cable retaining mechanisms having projections, flanges, or arms to grip a cable (U.S. Pat. Nos. 4,366,343; 4,389,535; 4,414,427; 4,424,406; 4,972,044; and 6,278,061). Other previous mechanisms include cord connectors having female and male portions or female and male receiving portions for connection of a cable or conduit, or two portions of a cable or conduit (U.S. Pat. Nos. 5,422,437 and 5,772,462). While these previous mechanisms did provide electrical connections, each previous mechanism was a separate component of the cover assembly, which could come loose from the electrical device or which could fail and require repair or replacement thereof. Furthermore, such mechanisms do not provide a quick connection in that they must be physically attached to the compressor, then the conduit or cable inserted and locked therein, thus requiring more time and effort for an electrical connection.

A terminal cover for a compressor which does not require multiple parts, which is not a separate component, and which provides quick connection of a conduit to the compressor would be desirable.

SUMMARY OF THE INVENTION

The above-described shortcomings of previous compressor electrical cover assemblies are overcome by providing a molded cover which includes an integral fitting therein with the integral fitting having a pair of resilient clips to engage the outer surface of a conduit inserted into the cover for connection to the compressor. The clips are structured and arranged such that the conduit may enter the cover with relative ease, yet be prevented from falling or pulled out of or being removed from the cover since the clips engage the outer surface of the conduit.

The present invention provides a hermetically sealed compressor assembly including a housing, an electric motor disposed in the housing, a compression mechanism disposed in the housing and operatively coupled to the motor, a cover attached to the housing and including an integral fitting having at least one clip therein. The clip is structured and arranged such that a conduit to be electrically connected to the compressor assembly enters the cover wherein the clip engages the conduit and prevents the egress of the conduit.

The present invention further provides a hermetic compressor assembly including a housing, an electric motor disposed in the housing, and a compression mechanism disposed in the housing and operatively coupled to the motor, an electrical conduit in electrical communication with the compressor assembly, and a terminal cover mounted on the exterior of the housing of the compressor assembly and receiving the electrical conduit. The terminal cover includes an integral fitting within the cover, and at least a pair of clips fixedly mounted in the integral fitting, with the clips being structured and arranged such that the electrical conduit is retained within the terminal cover.

The present invention further provides a hermetically sealed compressor assembly including a housing, an electric motor disposed in the housing, a compression mechanism disposed in the housing and operatively coupled to the motor, and a cover attached to the housing and including means for retaining an electrical conduit in the cover, with the means for retaining being integral with the cover.

BRIEF DESCRIPTION OF THE DRAWINGS

The above mentioned and other features and objects of this invention will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention and such exemplification is not to be construed as limiting the scope of the invention in any manner.

DETAILED DESCRIPTION

Figure 1:
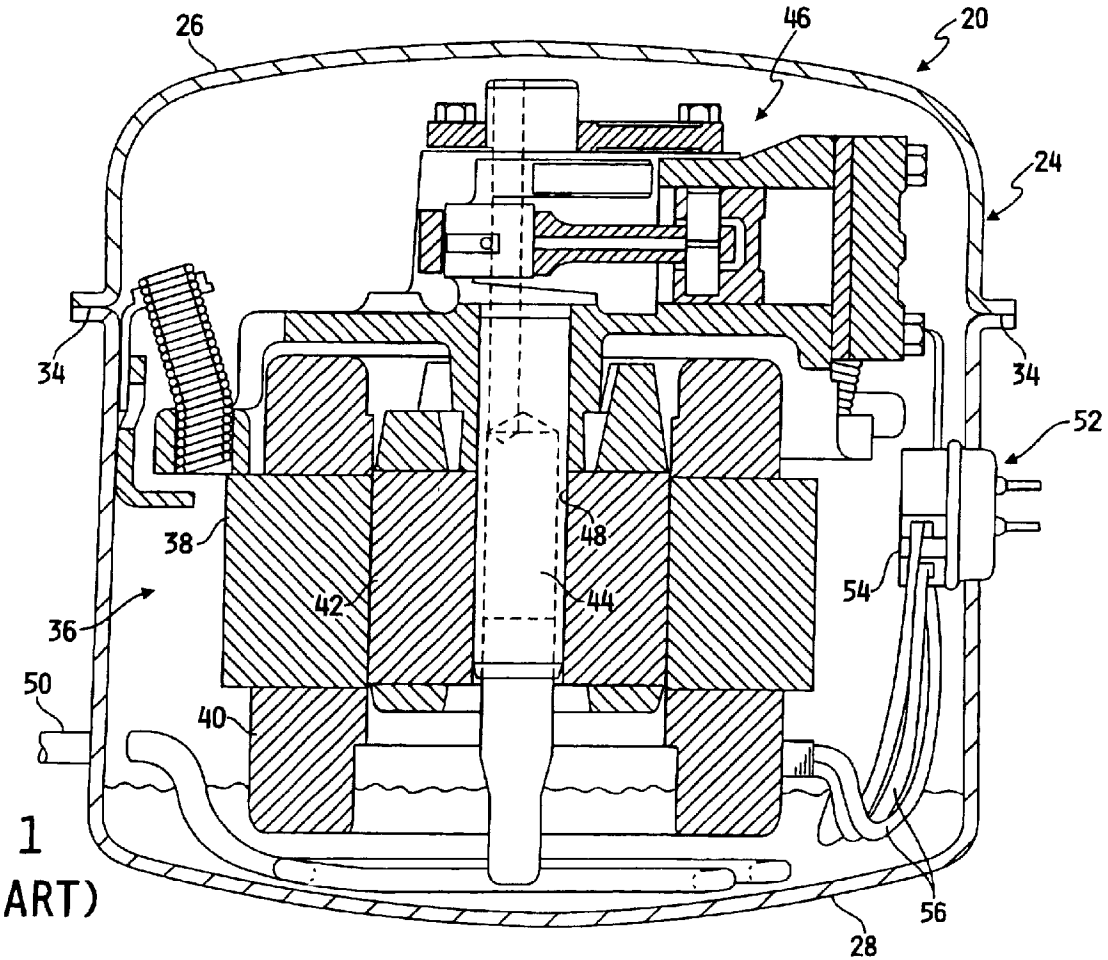
FIG. 1 (PRIOR ART)
FIG. 1 is a longitudinal sectional view of a reciprocating piston compressor assembly, with which the present invention may be used.

For the purposes of promoting an understanding of the principles of the invention, reference will now be made to the embodiment illustrated in the drawings and specific language will be used to describe the same. It will nevertheless be understood that no limitation of the scope of the invention is thereby intended.

Figure 2:
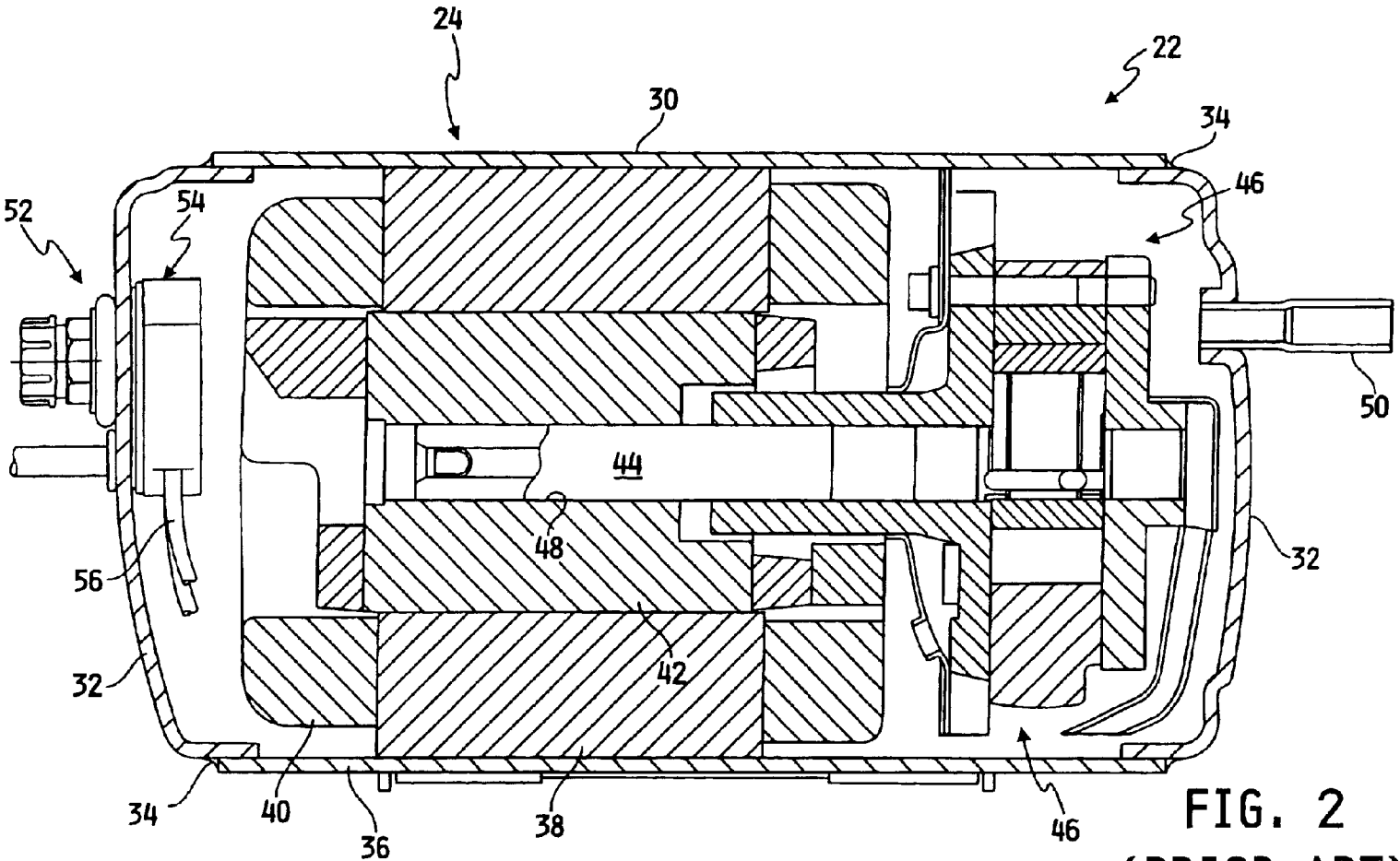
FIG. 2 (PRIOR ART)
FIG. 2 is a longitudinal sectional view of a rotary compressor assembly, with which the present invention may be used.

Referring to FIGS. 1 and 2, reciprocating compressor assembly 20 and rotary compressor assembly 22 are shown as examples of types of hermetic compressor assemblies in which the present invention may be advantageously used. Other hermetic compressor types, such as, for example, a scroll compressor assembly, may also benefit from use of present invention.

The compressor assembly, which may be part of a refrigeration system (not shown) also comprising heat exchangers, an expansion device and refrigerant conveying lines, receives refrigerant substantially at suction pressure and discharges it substantially at discharge pressure. The compressor assembly may be of a "high side" type, in which the portion of the housing in which the motor is located is at discharge pressure, or of a "low side" type, in which the portion of the housing in which the motor is located is at suction pressure. The present invention may be beneficially employed in either a high side or a low side type.

Reciprocating compressor assembly 20 (FIG. 1) comprises housing 24 which includes upper housing portion 26 disposed atop lower housing portion 28. Reciprocating compressor assembly 20 is of the low side type, and in operation, refrigerant gas is drawn first into housing 24, and then into compression mechanism 46, the compressed gas then discharged directly from the compression mechanism and the housing via discharge tube or shock loop 50 and recirculated through the refrigerant system.

Housing 24 of rotary compressor assembly 22 includes main housing portion 30 and two end portions 32 (FIG. 2). Rotary compressor assembly 22 is of the high side type, and in operation, refrigerant gas is drawn from outside its housing 24 directly into its compression mechanism 46 via a suction tube (not shown). Within compression mechanism 46, the gas is compressed to a higher, discharge pressure, and then discharged from the compression mechanism into its housing 24. Thereafter, the compressed gas is exhausted from the housing through discharge tube 50 and recirculated through a refrigerant system (not shown).

The housing portions for both compressor assemblies 20 and 22 are hermetically sealed at 34 by a method such as welding, brazing, or the like. Hermetic compressor assemblies 20 and 22 each also include electric motor 36 disposed within housing 24, which comprises stator 38 provided with windings 40, and rotor 42, that is surrounded by stator 38. Rotor 42 has central aperture 48 in which drive shaft, or crankshaft, 44 is secured by an interference fit.

As shown, an end of drive shaft 44 is operatively connected to compression mechanism 46, which may be of the reciprocating piston type, as in compressor assembly 20, or of the rotary type, as in compressor assembly 22, or of the scroll type (not shown), each of which is well-known in the art. The general structure and operation of a reciprocating compressor assembly is disclosed in U.S. Pat. No. 5,266,016, the complete disclosure of which is hereby expressly incorporated herein by reference. The general structure and operation of a rotary compressor assembly is disclosed in U.S. Pat. No. 5,222,885, the complete disclosure of which is hereby expressly incorporated herein by reference. The general structure and operation of a scroll compressor assembly is disclosed in U.S. Pat. No. 5,306,126, the complete disclosure of which is hereby expressly incorporated herein by reference. Each of these patents is assigned to Tecumseh Products Company, the assignee of the present invention.

In lower housing portion 28 of low side reciprocating compressor 20 (FIG. 1) and one of end portions 32 of high side rotary compressor 22 (FIG. 2) is an aperture, into which terminal assembly 52 is fitted and sealably secured by welding, brazing, or the like. In the manner discussed above, an external power source (not shown) is electrically connected to the conductor pins of terminal assembly 52, which are connected, through cluster block assembly 54 and jacketed lead wires 56 to stator windings 40.

Figure 3:
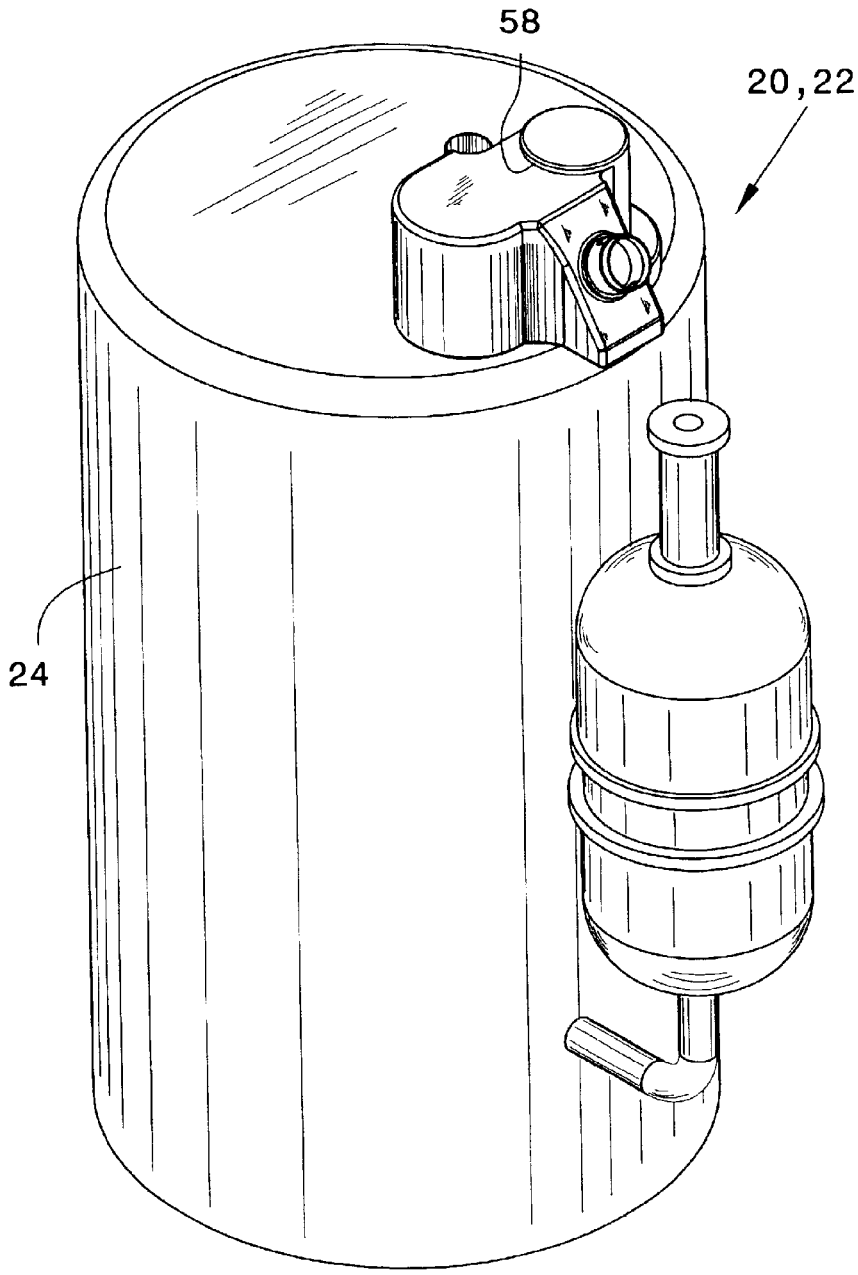
FIG. 3 is an oblique view of a compressor having a cover in accordance with the present invention mounted to the exterior thereof.

Referring now to FIG. 3, compressor assembly 20, 22 is shown as including conduit-ready terminal cover 58 mounted to housing 24 and into which conduit 70 (FIG. 5) for protection of the electrical connections is inserted. As described above, compressor assembly 20, 22 may be a rotary compressor assembly or a reciprocating compressor assembly. Alternatively, the compressor assembly may be a scroll compressor assembly.

Figure 4:
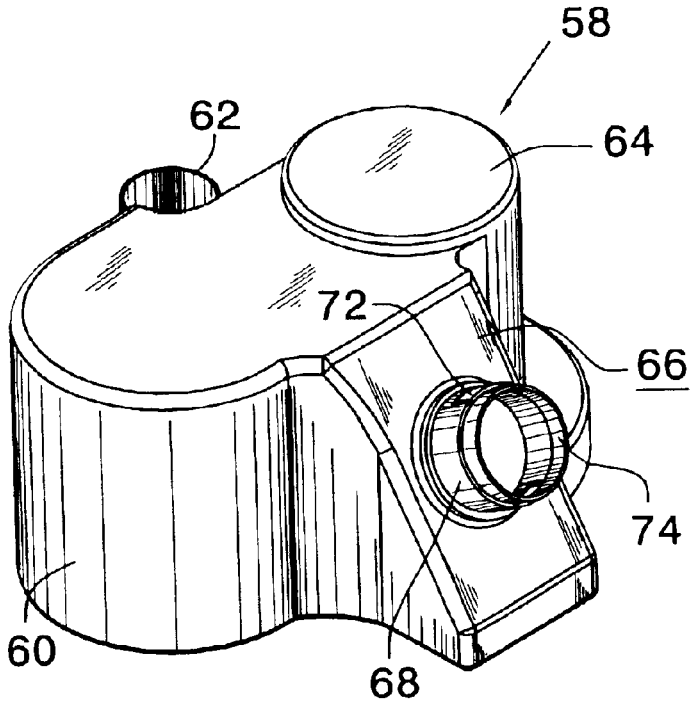
FIG. 4 is an upper perspective view of the cover of FIG. 3 detached from the compressor.

Conduit-ready terminal cover 58, as shown in FIG. 4, includes main body portion 60, which includes bore 62 on a side thereof for securing terminal cover 58 to housing 24 (FIG. 1) of compressor assembly 20, 22 (FIG. 1) by means of bolts or other such devices (not shown). Body 60 further includes a secondary rounded area 64, which may be used for the electrical connections and storage thereof.

Figure 5:
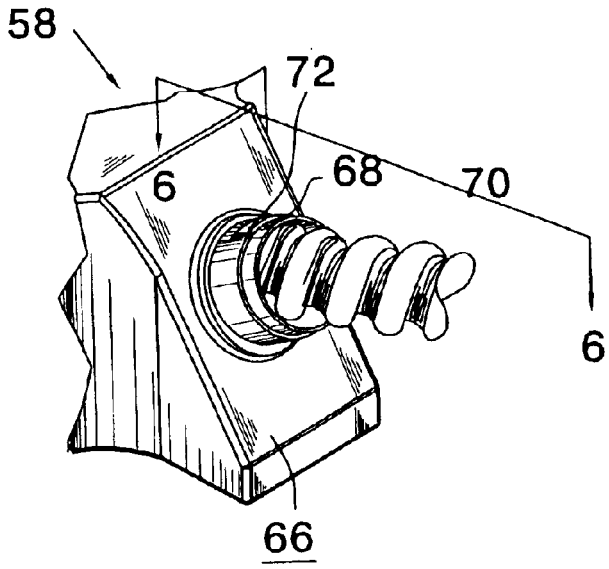
FIG. 5 is an enlarged fragmentary view of a portion of the cover of FIG. 4, with a conduit extending therefrom.

Surface 66 of cover 58 is disposed on a side located opposite of bore 62, and upon surface 66 is integrally formed fitting 68 into which conduit 70 (FIG. 5) is inserted for electrical connection to compressor assembly 20, 22. Fitting 68 includes a pair of integral clips 72 therein for secure attachment of conduit 70 to terminal cover 58 and further includes circumferential surface 74, which is used for guiding conduit 70, such that clips 72 may be engaged with conduit 70. With reference to FIG. 5, conduit 70 is shown as having been inserted in fitting 68 and extending therefrom.

Figure 6:
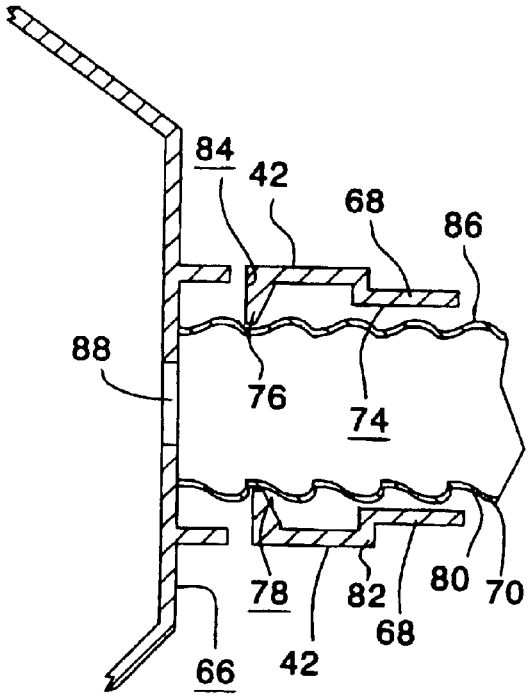
FIG. 6 is a sectional view of the cover and conduit of FIG. 5, along line 6—6.

Integral clips 72 are resilient and comprise arm portion 82 and extending portion 76, with extending portion 76 engaging the exterior of conduit 70, as shown in FIG. 6. Extending portions 76 each include oblique surface 78 thereon and interiorly facing flat surface 84 disposed opposite oblique surface 78, or toward the rear of clip 72. Such a structure allows clips 72 to engage conduit 70 such that conduit 70 may be inserted into fitting 68, but not withdrawn easily therefrom. Specifically, conduit 70 includes grooves 80 between rounded portions 86, which may be part of a single helical groove or separate corrugations, with clips 72, specifically extending portions 76, being able to be received in grooves 80. Since clips 72 are received in grooves 80, clips 72 may be slightly offset, as shown in FIG. 6, to correspond to the groove or may be directly across from each other if conduit 70 does not utilize a single helical groove.

Through the use of the oblique surfaces 78, conduit 70 is inserted into fitting 68 with clips 72 sliding over respective rounded portions 86 and into and out of grooves 80 until the desired position is reached. However, if conduit 70 is pulled in a direction opposite the insertion direction, surfaces 84 of extending portions 76 do not facilitate the same sliding action over rounded portions 86 and into grooves 80 as did oblique surfaces 78. Rather, surfaces 84 prevent similar sliding movement, thereby preventing withdrawal of conduit 70 from fitting 68. Surface 66 further includes aperture 88 such that the wires (not shown) disposed within conduit 70 may be inserted therethrough for electrical connection in compressor assembly 20, 22.

Since clips 72 are resilient, as conduit 70 is inserted, each respective clip portion 72 is able to oscillate or ratchet as extending portions 76 slide over conduit rounded portions 86 and into and out of grooves 80.

Although conduit 70 has been shown as having rounded portions 86 and grooves 80, other types of conduit may be utilized with fitting 68 and clips 72. Extending portions 76 of clips 72 extending inwardly of surface 74 of fitting 68 such that clips 72, specifically extending portions 76, will grasp conduit 70, which is inserted into fitting 68, provided the diameter of conduit 70 is not substantially less than the distance between each clip portion of clip 72. Thus, conduit such as PVC conduit or other smooth conduits may also be accommodated by this structure.

It is further to be noted that, although terminal cover 58 is shown as being mounted to the top portion of housing 24 of compressor assembly 20, cover 58 may alternatively be mounted in any location that would be the most convenient for insertion of conduit 70 and provision of the electrical connections necessary for compressor assembly 20. Furthermore, the shape of terminal cover 58 may be varied according to the size and capacity necessary or packaging requirements in each compressor application.

While this invention has been described as having an exemplary structure, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetically sealed compressor assembly comprising:

a housing;

an electric motor disposed in said housing;

a compression mechanism disposed in said housing and operatively coupled to said motor;

a cover attached to said housing, said cover including an integral fitting having at least one clip therein, said clip structured and arranged such that a conduit to be electrically connected to said compressor assembly enters said cover wherein said clip engages the conduit and prevents the egress of the conduit.

2. The compressor assembly of claim 1, wherein said clip includes an obliquely angle clip surface, said obliquely angled clip surface being pushed outwardly by and during ingress to the cover of the conduit.

3. The compressor assembly of claim 2, wherein said clip further includes an interiorly facing clip surface engaging the conduit outer surface and preventing egress of the conduit after ingress of the conduit.

4. The compressor assembly of claim 3, wherein said interiorly facing clip surface is disposed on said clip opposite said obliquely angled clip surface.

5. The compressor assembly of claim 2, wherein said obliquely angled surface faces substantially in the direction of ingress of the conduit.

6. The compressor assembly of claim 2, wherein said clip partially defines an opening in said cover, said opening receiving the conduit therein.

7. The compressor assembly of claim 6, wherein said housing defines an aperture for receipt of the conduit, said opening in said cover and said aperture being in alignment.

8. The compressor assembly of claim 1, wherein said clip includes an interiorly facing clip surface engaging the conduit outer surface and preventing egress of the conduit from the cover.

9. The compressor assembly of claim 1, wherein said cover is injection molded.

10. The compressor assembly of claim 1, wherein said clip is resiliently attached to said cover, said clip being capable of oscillatory movement.

11. The compressor assembly of claim 1, said housing defining an aperture for receipt of the conduit, said clip being aligned with said aperture whereby ingress of the conduit into said cover and said housing is facilitated.

12. A hermetic compressor assembly including:

a housing;

an electric motor disposed in said housing; and a compression mechanism disposed in said housing and operatively coupled to said motor;

an electrical conduit in electrical communication with said compressor assembly; and a terminal cover mounted on the exterior of said compressor shell and receiving said electrical conduit, said terminal cover including an integral fitting within said cover; and at least a pair of clips fixedly mounted in said integral fitting, said clips structured and arranged such that said electrical conduit is retained within said terminal cover.

13. The hermetic compressor assembly of claim 12, wherein said clips include obliquely angled clip surfaces, said obliquely angled clip surfaces being pushed outwardly during entry of said conduit into said terminal cover.

14. The hermetic compressor assembly of claim 13, wherein said clips further include interiorly facing clip surfaces, said interiorly facing clip surfaces engaging said outer surface of said conduit after entry of said conduit into said terminal cover.

15. The hermetic compressor assembly of claim 14, wherein said interiorly facing clip surfaces are disposed opposite said obliquely angled clip surfaces.

16. The hermetic compressor assembly of claim 13, wherein said obliquely angled surfaces face substantially in the direction of ingress of the conduit.

17. A hermetically sealed compressor assembly comprising:

a housing;

an electric motor disposed in said housing;

a compression mechanism disposed in said housing and operatively coupled to said motor; and a cover attached to said housing, said cover including means for retaining an electrical conduit in said cover, said means for retaining being integral with said cover.

18. The compressor assembly of claim 17, wherein said means has a first condition in which said means are not engaged with the electrical conduit and a second condition in which said means are engaged with the electrical conduit.

19. The compressor assembly of claim 18, wherein said means when in said second condition prevent egress of the conduit from said cover.

20. The compressor assembly of claim 18, wherein the electrical conduit is prevented from being removed from said cover by said means for retaining when said means for retaining are in said second condition.

* * * * *